United States Patent [19]

Alker

[11] Patent Number: 4,920,582

[45] Date of Patent: May 1, 1990

[54] UNIVERSAL WASTE AND OVERFLOW DRAIN ASSEMBLY

[76] Inventor: James R. Alker, 5898 12th Ave. N.W., Rochester, Minn. 55901

[21] Appl. No.: 360,372

[22] Filed: Jun. 20, 1989

[51] Int. Cl.[5] ..... E03C 1/24; E03C 1/22

[52] U.S. Cl. ..... 4/198; 4/199; 4/206; 4/191; 4/DIG. 7

[58] Field of Search ..... 4/198, 199, 195, 191, 4/206, DIG. 7, 208; 285/12

[56] References Cited

U.S. PATENT DOCUMENTS

| | | | |
|---|---|---|---|
| 1,012,041 | 12/1911 | Weaver | 4/199 |
| 1,593,642 | 7/1926 | Allingham | 4/199 |
| 1,605,690 | 11/1926 | Pasman | 4/199 |
| 1,658,159 | 2/1928 | Ernst et al. | 4/198 |
| 1,671,345 | 2/1928 | Speakman | 4/199 |
| 1,781,719 | 11/1930 | Darling | 4/199 |
| 1,870,089 | 8/1932 | Block | 4/199 |
| 2,122,620 | 7/1938 | Nystrom | 4/199 |
| 2,184,001 | 12/1939 | Nystrom | 4/199 |
| 4,194,252 | 3/1980 | Tsuei | 4/206 |
| 4,352,213 | 10/1982 | Watts | 4/199 |
| 4,720,877 | 1/1988 | Watts | 4/286 |

FOREIGN PATENT DOCUMENTS

| | | | |
|---|---|---|---|
| 204211 | 9/1923 | United Kingdom | 4/198 |

*Primary Examiner*—Henry J. Recla
*Assistant Examiner*—Keith Kupferschmid
*Attorney, Agent, or Firm*—John W. Bunch

[57] ABSTRACT

A universal bath waste and overflow drain assembly (10) comprises an overflow tube (12), drain pipe (14), t-connector (16), and an adapter (18) which can be interchanged and connected as desired in different drain configurations according to the requirements of the particular.

11 Claims, 2 Drawing Sheets

UNIVERSAL WASTE AND OVERFLOW DRAIN ASSEMBLY

TECHNICAL FIELD

The present invention relates generally to a drain assembly for use with bathtubs. More particularly, this invention concerns a universal bath waste system which is adapted for arrangement in various configurations to accommodate different drain and overflow placements, subflooring patterns, etc.

BACKGROUND ART

New home construction typically involves the installation of at least one bathtub, which usually includes two drain openings. The main drain opening is located in the bottom of the tub, while the overflow drain opening is located in the end of the tub adjacent to the main drain opening but just below the top of the tub. Both drain openings must in turn be connected to the drain system. However, various difficulties can be encountered depending upon the requirements of the particular installation, which can vary drastically from one house to another. It will be appreciated that the floor loading in a bathroom can be relatively high, particularly under and adjacent to the bathtub. Depending upon the design and construction of the particular house, different underflooring and supporting joist arrangements may be encountered which in turn call for a particular drain configuration. At the present time, such drain arrangements are custom fit to the job by means of various fittings. This can be both expensive and time consuming, depending upon availability of the necessary fittings. There is no provision for adjustability and little or no tolerance for slight movement after installation which can result in leaks.

Various drain assemblies and control mechanisms have been developed heretofore. For example, U.S. Pat. Nos. 4,744,108 to Schmidt, 4,669,131 to Barlow, 4,594,738 to Gabert and 2,607,045 to Morris are representative of the prior art in this regard. However, there has not been available heretofore a drain assembly which can readily be adapted to different drain configurations without additional fittings, cutting, etc.

A need has thus arisen for a universal bath waste and overflow drain assembly which accommodates different drain configurations without additional fittings.

SUMMARY OF THE INVENTION

The present invention comprises an improved drain assembly which overcomes the foregoing and other problems associated with the prior art. In accordance with the invention, there is provided a universal bath waste and overflow drain assembly comprising an overflow tube, t-connector, drain pipe or "shoe", and adapter which can be arranged and connected in different drain configurations depending upon the requirements of the particular installation. Regardless of the particular configuration of the assembly, the male portion of each connection is always upstream from the female portion for best drainage and minimal susceptibility to leakage.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
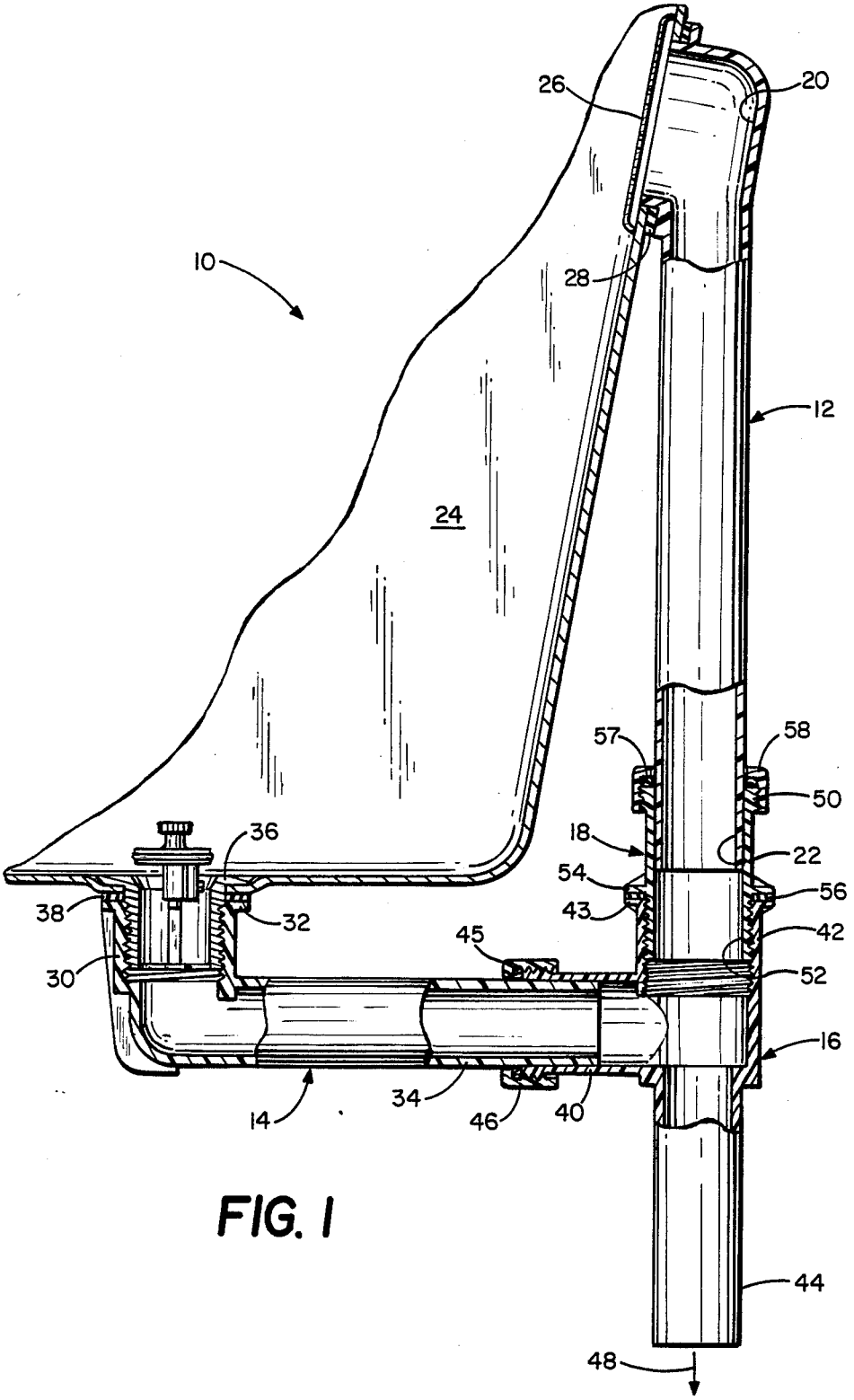
FIG. 1 is a partial vertical section view of the universal waste and overflow assembly of the invention in one drain configuration.

Referring now to the Drawings, wherein like reference numerals designate like or corresponding elements throughout the views, and particularly referring to FIG. 1, there is shown the universal bath waste and overflow drain assembly 10 comprising the invention. The drain assembly 10 is arranged in a standard drain configuration, however, as will be explained more fully hereinafter, the assembly can be readily adapted to other drain configurations for more versatility but without additional fittings.

The universal waste and overflow drain assembly 10 comprises an upright overflow tube 12, drain pipe 14, t-connector 16, and adapter 18. The components of the assembly 10 can be constructed from any suitable material, such as polypropylene PVC. The overflow tube 12, which is of substantially conventional construction, includes a curved, flanged end 20 and a straight smooth end 22. The flanged end 20 of the overflow tube 12 is adapted for connection to the overflow drain opening in tub 24. As shown, a cover plate 26 and a gasket seal or washer 28 are secured to the overflow tube 12 on opposite sides of the wall of the tub 24.

The drain pipe 14 includes a curved, internally threaded end 30 with a flange 32 thereon, and a straight smooth end 34. The flange 32 is preferably flush with the end 30. The internally threaded, curved end 30 of the drain pipe 16 is preferably curved at about, 90°,, and is connected to the main drain opening in tub, as shown, 24. A strainer 36 and a gasket seal or washer 38 are secured to the drain pipe 14 on opposite sides of the bottom of the tub 24.

The t-connector 16 includes an externally threaded base stem 40, and opposing straight ends 42 and 44. A flange 43 is provided on end 42. The end 42 is externally threaded, while the other end 44 is smooth as shown. In the standard drain configuration of FIG. 1, the smooth end 34 of the drain pipe 14 is received in a slip fit within the base end 40 of the t-connector 16, and secured against leakage by means of an o-ring seal 45 and a compression nut 46. The arrow 48 indicates drain flow out of the assembly 10 through the smooth end 44 of the t-connector 16.

The adapter 18 includes opposing straight externally threaded ends 50 and 52, and a flange 54 inset from and adjoining the threaded end 52 thereof. As shown in FIG. 1, the externally threaded end 52 of adapter 18 is screwed into the internally threaded end 42 of the t-connector 16. A gasket seal or washer 56 is provided between the flange 54 on adapter 18 and the flange 43 on the t-connector 16. The smooth end 22 of the overflow tube 12 is received into the end 50 of adapter 18 in a slip fit, and is secured against leakage by means of an o-ring seal 57 and a compression nut 58.

In accordance with the preferred construction, the flange 32 of drain pipe 14 is offset from the centerline of the end 34 thereof the same distance; e.g., about two inches, as the flange 43 on t-connector 16 is offset from the centerline of end 40 thereof. Similarly, the flange 54 on adapter 18 is also offset the same distance from end 50 thereof, for clearance and interchangeability. The externally threaded end 52 of adapter 18 is adapted for threaded engagement into either the end 42 of t-connection 16, or the end 30 of the drain pipe 14. The internal diameter of the adapter 18 is the same as that of end 40 of the t-connector 16 so as to form a slip fit connection with either the overflow tube 12 or the drain pipe 14.

Figure 2:
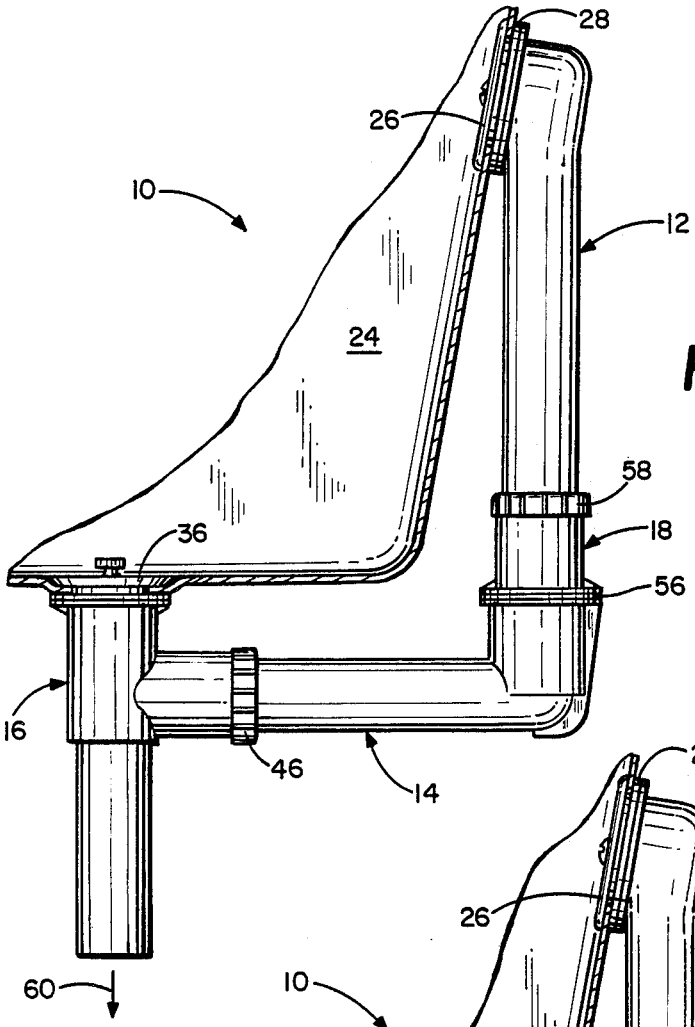
FIG. 2 is a reduced side view of the invention, but in another drain configuration.

FIG. 2 shows the drain assembly 10 herein connected in a different arrangement so as to provide a direct drain. In the arrangement of FIG. 2, the t-connector 16 and drain pipe 14 are reversed so that the drain flow as indicated by arrow 60 is directly downward from the strainer 36.

Figure 3:
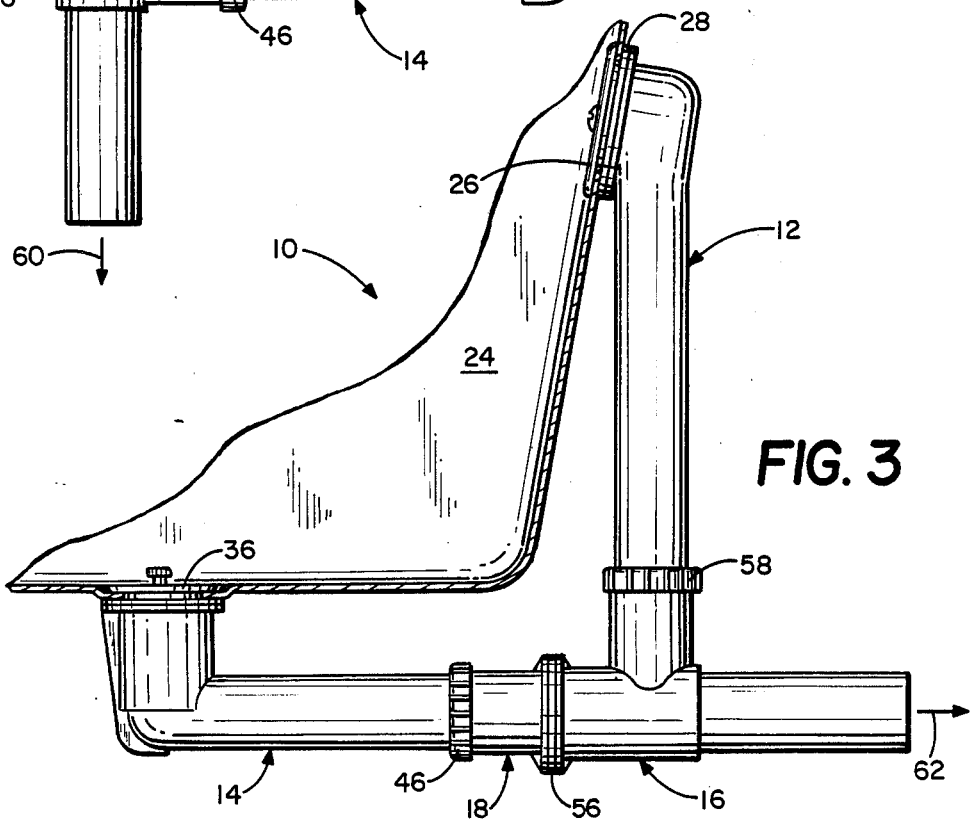
FIG. 3 is a reduced side view of the invention, but in yet another drain configuration.

FIG. 3 shows the drain assembly 10 of the invention connected in yet another arrangement so as to provide a horizontal drain configuration as indicated by arrow 62.

From the foregoing, it will thus be appreciated that the present invention comprises an improved waste and overflow drain assembly having several advantages over the prior art. One particular advantage is greater versatility and adjustability so that different drain configurations can be accommodated simply by rearranging the same components, and without additional fittings. This in turn simplifies installation and reduces expense. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangements of elements falling within the scope of the invention as defined by the following Claims.

What is claimed is:

1. A universal drain assembly for use with a bathtub having a main drain opening with an externally threaded tubular member mounted therein, and an overflow drain opening, which comprises:

an overflow tube adapted for connection at one end thereof to the overflow drain opening and having a length such that the opposite end thereof terminates adjacent the lower end of the bathtub;

a drain pipe;

said drain pipe having a turned, internally threaded end adapted to be connected to the tubular member, and an opposite straight end;

a t-connector;

said t-connector having a lateral, externally threaded stem and straight, opposing ends, one of which is internally threaded and adapted to be connected to the tubular member;

an adapter having straight, opposing externally threaded ends;

one end of said adapter having an internal diameter sized to selectively receive the opposite end of said overflow tube and the straight end of said drain pipe therein;

means for circumferentially sealing and securing the one end of said adapter to the selected other end of said overflow tube or the straight end of said drain pipe;

the other end of said adapter being adapted for selective threaded engagement with the internally threaded end of said t-connector and the internally threaded end of said drain pipe, whereby in order to vary the location of drainage out the other straight end of said t-connector as desired, said universal drain assembly can be assembled in one of the following configurations; (1) with the one end of said adapter connected to the opposite end of said overflow tube, the other end of said adapter connected to the internally threaded end of said t-connector, the internally threaded end of said drain pipe connected to the tubular member, and the straight end of said drain pipe connected to the stem of said t-connector: (2) with the one end of said adapter connected to the opposite end of said overflow tube, the other end of said adapter connected to the internally threaded end of said drain pipe, the internally threaded end of said t-connector connected to the tubular member, and the straight end of said drain pipe connected to the stem of said t-connector; and (3) with the one end of said adapter connected to the straight end of said drain pipe, the other end of said adapter connected to the internally threaded end of said t-connector, the internally threaded end of said drain pipe connected to the tubular member, and the stem of said t-connector connected to the opposite end of said overflow tube; and means for circumferentially sealing and securing the stem of said t-connector to the selected other end of said overflow tube or the straight end of said drain pipe.

2. The universal drain assembly of claim 1, wherein said overflow tube is integrally formed from plastic.

3. The universal drain assembly of claim 1, wherein said drain pipe is integrally formed from plastic.

4. The universal drain assembly of claim 1, wherein said t-connector is integrally formed from plastic.

5. The universal drain assembly of claim 1, wherein said adapter is integrally formed from plastic.

6. The universal drain assembly of claim 1, wherein said means for circumferentially sealing and securing the said one end of adapter comprises a compression nut and associated o-ring.

7. The universal drain assembly of claim 1, wherein said means for circumferentially sealing and securing the stem of said connector comprises a compression nut and associated o-ring.

8. The universal drain assembly of claim 1, further including:

a surrounding flange on the internally threaded end of said drain pipe.

9. The universal drain assembly of claim 1, further including:

a surrounding flange on the internally threaded end of said t-connector.

10. The universal drain assembly of claim 1, further including:

a surrounding flange between the externally threaded ends of said adapter.

11. A universal drain assembly for use with a bathtub having a main drain opening and an overflow drain opening, which comprises:

an overflow tube adapted for connection at one end thereof to the overflow drain opening and having a length such that the opposite end thereof terminates adjacent the lower end of the bathtub;

a drain pipe;

an externally threaded tubular member adapted to be mounted in the main drain opening;

said drain pipe having a turned, internally threaded end adapted to be connected to said tubular member, and an opposite straight end;

a t-connector;

said t-connector having a lateral, externally threaded stem and straight, opposing ends, one of which is internally threaded and adapted to be connected to said tubular member;

an adapter having straight, opposing externally threaded ends;

one end of said adapter having an internal diameter sized to selectively receive the opposite end of said overflow tube and the straight end of said drain pipe therein;

means for circumferentially sealing and securing the one end of said adapter to the selected other end of said overflow tube of the straight end of said drain pipe;

the other end of said adapter being adapted for selective threaded engagement with the internally threaded end of said t-connector and the internally threaded end of said drain pipe, whereby in order to vary the location of drainage out the other straight end of said t-connector as desired, said universal drain assembly can be assembled in one of the following configurations: (1) with the one end of said adapter connected to the opposite end of said overflow tube, the other end of said adapter connected to the internally threaded end of said t-connector, the internally threaded end of said drain pipe connected to the said tubular member, and the straight end of said drain pipe connected to the stem of said t-connector; (2) with the one end of said adapter connected to the opposite end of said overflow tube, the other end of said adapter connected to the internally threaded end of said drain pipe, the internally threaded end of said t-connector connected to the said tubular member, and the straight end of said drain pipe connected to the stem of said t-connector: and (3) with the one end of said adapter connected to the straight end of said drain pipe, the other end of said adapter connected to the internally threaded end of said t-connector, the internally threaded end of said drain pipe connected to the said tubular member, and the stem of said t-connector connected to the opposite end of said overflow tube; and means for circumferentially sealing and securing the stem of said t-connector to the selected other end of said overflow tube or the straight end of said drain pipe.

* * * * *